US007743915B2

(12) United States Patent
Murphy

(10) Patent No.: US 7,743,915 B2
(45) Date of Patent: Jun. 29, 2010

(54) CARTON HAVING ADJUSTMENT INDICIA

(75) Inventor: John L. Murphy, Midlothian, VA (US)

(73) Assignee: Meadwestvaco Corporation, Glen Allen, VA (US)

( * ) Notice: Subject to any disclaimer, the term of this patent is extended or adjusted under 35 U.S.C. 154(b) by 303 days.

(21) Appl. No.: 11/469,628

(22) Filed: Sep. 1, 2006

(65) Prior Publication Data

US 2007/0170081 A1 Jul. 26, 2007

Related U.S. Application Data

(60) Provisional application No. 60/761,651, filed on Jan. 24, 2006.

(51) Int. Cl.
*A24F 15/00* (2006.01)

(52) U.S. Cl. ..... 206/273; 206/459.5

(58) Field of Classification Search ..... 206/459.5, 206/232, 395, 248, 273, 459; 40/312, 313; 229/101, 101.1; 53/493
See application file for complete search history.

(56) References Cited

U.S. PATENT DOCUMENTS 217,190 A * 7/1879 Osborne ..... 229/89
397,475 A * 2/1889 Tiffany ..... 33/1 F
2,182,858 A * 12/1939 Thompson ..... 229/108
2,214,230 A * 9/1940 Freeburg ..... 206/723
3,042,278 A * 7/1962 McCullough ..... 225/39
RE26,663 E * 9/1969 Dwyer, Jr. ..... 206/449
3,598,303 A * 8/1971 Folz ..... 229/101
3,902,656 A * 9/1975 Rothchild ..... 229/75
3,905,768 A * 9/1975 Hach ..... 436/163
4,268,967 A * 5/1981 Brana et al. ..... 33/1 V
4,706,805 A 11/1987 Becher
4,793,478 A 12/1988 Tudor
5,692,500 A * 12/1997 Gaston-Johansson ..... 600/300
6,393,707 B1 * 5/2002 Maffei ..... 33/1 SD
6,568,587 B1 * 5/2003 Yamada et al. ..... 229/162.1
2006/0011504 A1 * 1/2006 Gosebruch et al. ..... 206/459.5

OTHER PUBLICATIONS

Monka-Uhlig, R. "Verpackung Mit Kennzeichnung." German Publication No. DE20201941, published May 16, 2002.
Abel, L. "Emballage Pour Cigarettes." Suisse Publication No. CH 466791, published Dec. 15, 1968.
Barnaengen GmbH. "Verpackung Fur Kerzen." German Publication No. DE7430633 published Mar. 20, 1975.

* cited by examiner

*Primary Examiner*—Mickey Yu
*Assistant Examiner*—Jenine M Pagan

(57) ABSTRACT

Cartons are disclosed for packaging articles, wherein the cartons have indicia printed thereon to facilitate adjustment of the dimensions of the blanks used to form the cartons, or of the forming machinery on which such cartons may be erected.

11 Claims, 4 Drawing Sheets

CARTON HAVING ADJUSTMENT INDICIA

CROSS-REFERENCE TO RELATED APPLICATIONS

This application claims the benefit of priority under 35 U.S.C. §119(e) of provisional application Ser. No. 60/761,651, filed on Jan. 24, 2006.

BACKGROUND OF THE INVENTION

This invention relates generally to cartons for packaging articles such as cigarettes, and more particularly to a carton having indicia printed thereon to facilitate adjustment of the dimensions of the blanks used to form the cartons, or of the forming machinery on which such cartons may be erected.

Folded paperboard cartons for packaging articles such as cigarettes are well known in the art. An example of a "flip-top" style carton is disclosed in U.S. Pat. No. 4,793,478. Such cartons are typically manufactured in the form of a flat blank that is printed, cut and scored and then shipped in quantities in flat condition to the manufacturing point of the cigarettes. There, the carton blanks are loaded into high-speed carton forming machinery in which each carton blank is folded, loaded with contents and glued, resulting in filled, completed packages.

For both functional and aesthetic reasons it is important that the cartons be precisely formed. The cartons are typically printed with advertising, informational or aesthetic graphics that can be misaligned and unattractive on the completed package. Additionally, if the carton blanks are erected in a misaligned manner, they may create difficulty in moving the cartons through the machine, or in handling and stacking the completed packages. For these reasons, the blank must be carefully sized, and the packaging machinery is capable of fine adjustment that can make changes to the extent to which panels are folded or moved as they pass through the machine.

Achieving proper panel dimensions or machine adjustment can be a tedious procedure. To this end, it is known to use a test blank having lines or other marks located along the edges of the blank so that when the test blank is formed into a carton, the marks will be aligned if the carton is properly formed. If not, then the blank or machine can be adjusted. However, if determination of the extent of misalignment can be made more efficient and precise, then blank or machine adjustment can be made more quickly and with fewer iterations.

SUMMARY OF THE INVENTION

The present invention provides a folding carton blank including first and second panels that may be folded into position to form an erected carton, with the first panel having a panel edge wherein the panel edge is disposed adjacent the second panel in the erected carton. An alignment indicia is defined having a first portion formed along the panel edge and a second portion formed on the second panel adjacent the panel edge. At least one of the first and second indicia portions is comprised of an indicator scale having gradations and gradation values, and the other of the first and second indicia portions comprises an indicator for marking a gradation along the scale.

In use, the indicia portions are used to determine the registration position of the panel edge with the second panel, whereupon machine adjustments may be made as necessary.

DETAILED DESCRIPTION OF THE PREFERRED EMBODIMENTS

Figure 1:
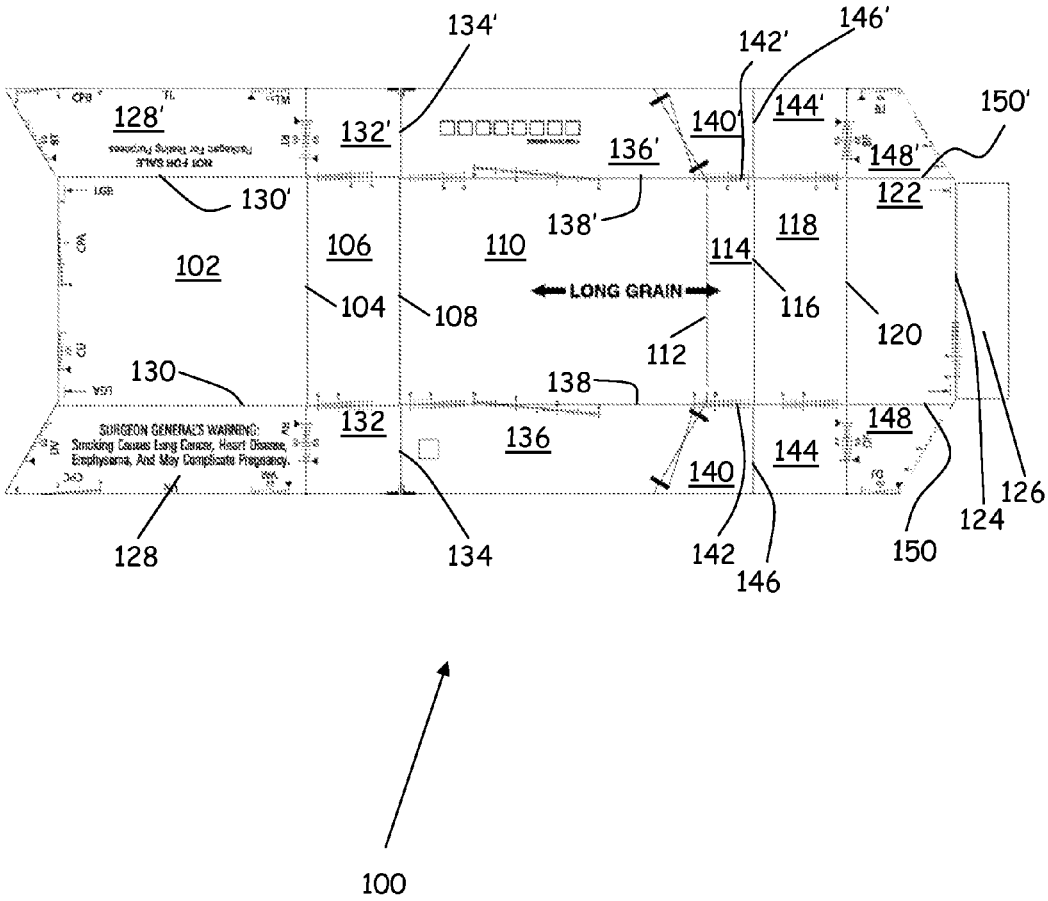
FIG. 1 shows the outer surface of a carton blank for use with present invention.
Figure 2:
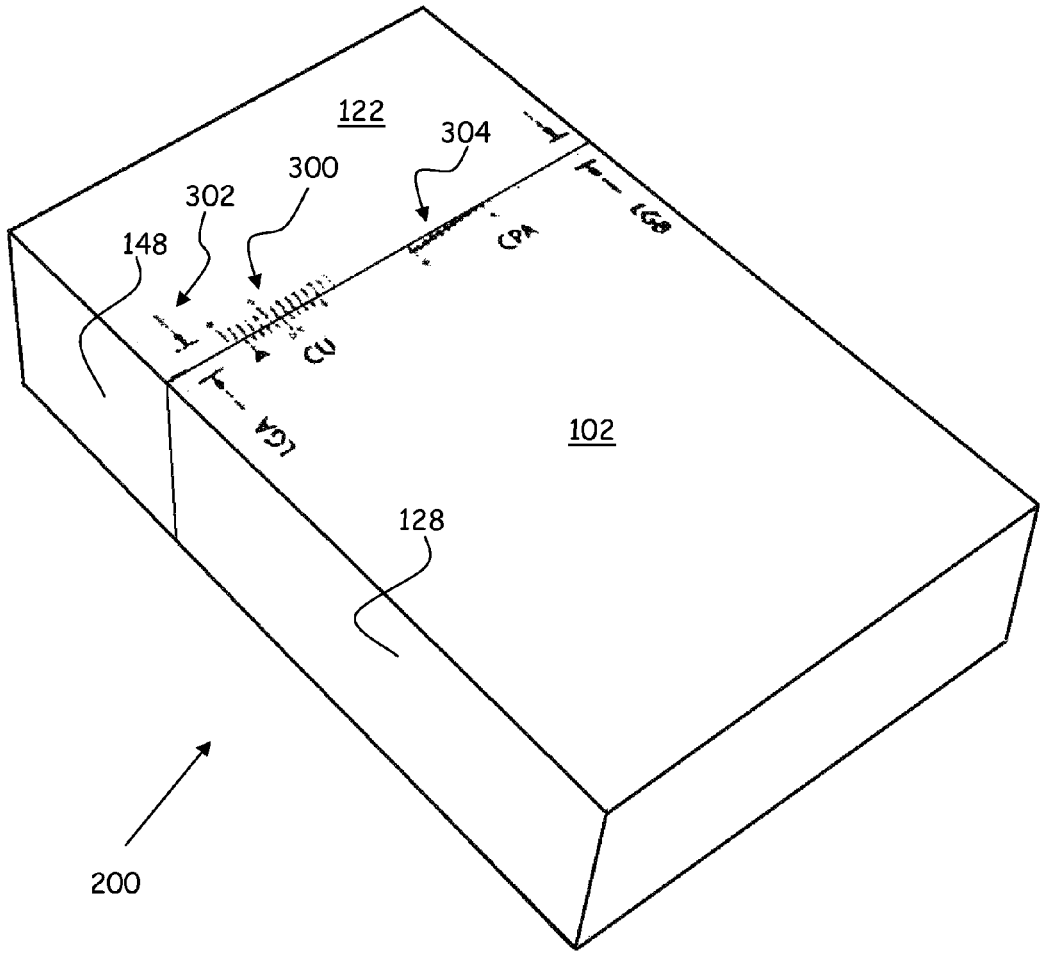
FIG. 2 is a perspective view of a completed carton erected from the blank of FIG. 1, taken from the lower front left corner.

In FIG. 1, there is shown a blank 100 which when constructed, forms a carton 200 shown in FIG. 2 for packaging a plurality of articles such as cigarettes. The blank is typical of those used in forming cigarette packages, but the specific structure of the blank and the resulting carton is not critical.

The blank includes a front main panel 102 connected along fold line 104 to bottom panel 106, which is in turn connected along fold line 108 to rear main panel 110. Fold line 112 connects rear main panel to upper rear panel 114, which is connected by fold line 116 to top panel 118. Fold line 120 connects upper front panel 122 to top panel 118, and fold line 124 connects upper front panel 122 to tuck flap 126.

An outer side flap 128 is connected along fold line 130 to main front panel 102. A bottom dust flap 132 is connected along fold line 134 to an inner side flap 136, which is in turn connected along fold line 138 to rear main panel 110. An upper inner side flap 140 is connected along fold line 142 to upper rear panel 114. Top dust flap 144 is connected along fold line 146 to upper inner side flap 140. Finally, outer upper side panel 148 is connected to upper front panel 122 along fold line 150.

Corresponding outer side flap 128', bottom dust flap 132', inner side flap 136', upper inner side flap 140', top dust flap 144', and outer upper side panel 148' are connected along fold lines 130', 134', 138', 142', 146', and 150' in a similar manner to the opposite side of blank 100.

The blank 100 is loaded into the supply hopper (not shown) of conventional carton erecting machinery and erected in a well-known manner into the carton 200 shown in FIG. 2. It will be noted that at a number of locations on carton 200, an edge of a carton panel is secured to a position on or adjacent to another carton panel. Proper positioning of these panels is important both for effective mechanical functioning of the carton and for proper matching of graphics which is typically printed on commercially-distributed retail packaging.

Carton 200 is a test carton for evaluating the positioning of the carton panels with respect to each other. To this end, the carton 200 includes measurement indicia 300, 302 and 304 shown at several locations on carton 200.

Figure 3:
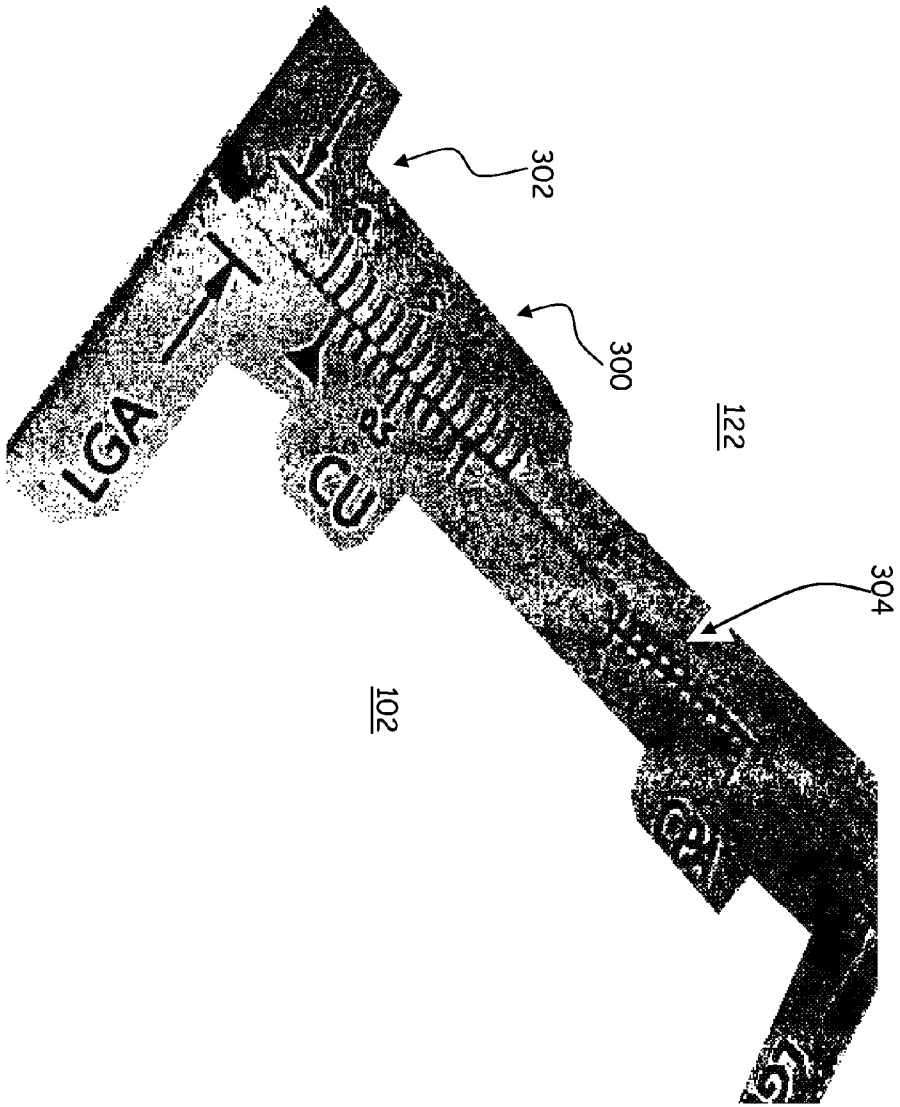
FIG. 3 is an expanded view of the carton of FIG. 2.

An enlarged view of the indicia can be seen in FIG. 3. Indicia 300 is a vernier scale, with the primary portion of the scale formed along an edge of panel 122, while the secondary portion of the scale is formed along the edge of panel 102. The primary portion may have its increments formed at specific reference intervals, such as for example 1 mm, or some other measurement scale that is convenient for the user. The measurement value is read in a conventional manner. It will be recognized that the primary and secondary portions of the scale may be reversed.

A second type of indicia can be seen at 302. This indicia does not include a printed measurement scale, with the panel positioning being simply measured (e.g. with a ruler) as the distance between the two portions of the indicia on panels 122 and 102.

Figure 4:
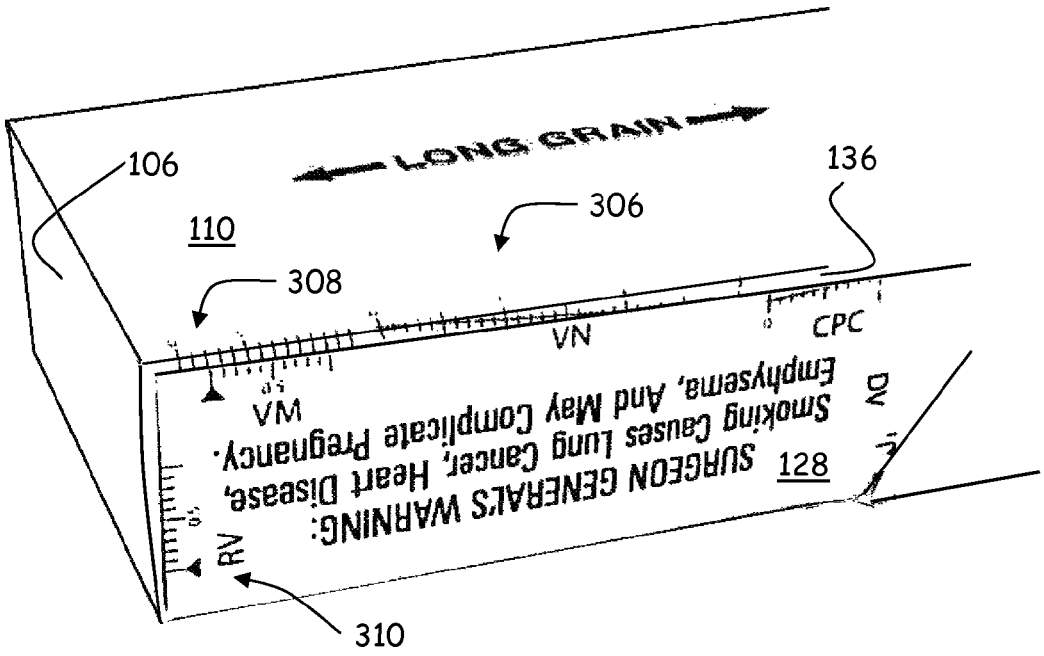
FIG. 4 is a perspective view of a completed carton erected from the blank of FIG. 1, taken from the lower rear right corner.

A third type of indicia can be seen at 304 and, more clearly as indicia 306 in FIG. 4. A scale is printed on an angular orientation to extend across two panels connected by a fold line, shown here by panels 110 and 136. An overlapping panel 128 has an edge that lies along the line, thereby enabling the scale to be read.

Additional vernier-type scales 308 and 310 can also be seen in FIG. 4.

In use, one or a small number of blanks 100 are processed through the erecting machinery and the various indicia are read. Using the measurements so obtained, the blank dimensions may be revised for subsequent blank production, and/or the erecting machinery may be adjusted, as appropriate.

What is claimed is:

1. A folding carton blank comprising:

(a) a first panel having a first indicia marked along an edge of said first panel; and (b) a second panel having a second indicia marked along an edge of said second panel, wherein a carton is erected by folding said blank such that said first panel is adjacent to said second panel, and said first indicia on said first panel are aligned with said second indicia on said second panel, and wherein said first indicia comprises a first indicator scale having gradations at a first spacing, and said second indicia comprises a second indicator scale having gradations at a second spacing different than the first spacing, said second indicia also comprising an indicator for marking a gradation along said first indicator scale, and wherein after folding said blank, said first indicia and second indicia are used to measure an alignment or misalignment of said first and second panels;

wherein said first and second indicia form a vernier scale.

2. The carton blank of claim 1 wherein said first indicia and said second indicia are formed by printing.

3. The carton blank of claim 1, wherein said first indicia and said second indicia include gradation values.

4. The carton blank of claim 1, wherein said first indicia comprises a linear scale.

5. A folding carton blank comprising first and second panels for folding into position to form an erected carton, said first panel defining a panel edge such that the panel edge is disposed adjacent said second panel in the erected carton, and an alignment indicia formed on said first and second panels having a first indicia portion formed along said panel edge and a second indicia portion formed on said second panel to be adjacent said panel edge in the erected carton, wherein a measurement is made between said first and second indicia portions to measure an alignment or misalignment of said first and second panels, wherein said first and second indicia portion form a vernier scale with said first indicia portion comprising a first indicator scale having gradations at a first spacing, and said second indicia comprising a second indicator scale having gradations at a second spacing different than the first spacing.

6. The carton blank of claim 5, wherein said first and second panels are essentially coplanar in the erected carton.

7. The carton blank of claim 5 wherein said first indicia and said second indicia are formed by printing.

8. A folding carton blank comprising:

first panel and second panel for folding into position to form an erected carton, said first panel defining a panel edge such that said panel edge is disposed adjacent to said second panel in said erected carton, said second panel connected to a third panel by a fold line, an indicator scale extending at an acute angle to said fold line, said acute angle being greater than zero degrees and less than 15 degrees, wherein said indicator scale has gradations, and said edge and said indicator scale provide a measurement of an alignment or misalignment of said first and second panels.

9. The carton blank of claim 8, wherein said scale is coincident with the edge of said carton blank.

10. The carton blank of claim 8 wherein said indicator scale is formed by printing.

11. The carton blank of claim 8 wherein said indicator scale includes gradation values.

* * * * *